US009410393B2

(12) United States Patent
Larson et al.

(10) Patent No.: US 9,410,393 B2
(45) Date of Patent: Aug. 9, 2016

(54) PRESSURE ASSISTED BLOWOUT PREVENTER

(71) Applicant: Hydril USA Manufacturing LLC, Houston, TX (US)

(72) Inventors: Eric Dale Larson, Houston, TX (US); Brian Scott Baker, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 0 days.

(21) Appl. No.: 14/104,898

(22) Filed: Dec. 12, 2013

(65) Prior Publication Data

US 2015/0167417 A1 Jun. 18, 2015

(51) Int. Cl.

| | |
|---|---|
| ***E21B 33/06*** | (2006.01) |
| ***E21B 7/12*** | (2006.01) |
| ***F15B 15/26*** | (2006.01) |
| ***E21B 29/12*** | (2006.01) |
| ***F16D 31/02*** | (2006.01) |
| ***E21B 29/00*** | (2006.01) |
| ***E21B 34/04*** | (2006.01) |

(52) U.S. Cl.

CPC ..... *E21B 33/061* (2013.01); *E21B 33/062* (2013.01); *E21B 34/04* (2013.01)

(58) Field of Classification Search

None

See application file for complete search history.

(56) References Cited

U.S. PATENT DOCUMENTS

| | | | | |
|---|---|---|---|---|
| 1,854,058 | A | 4/1932 | Otis | |
| 3,743,013 | A | 7/1973 | Harbonn | |
| 3,933,338 | A | 1/1976 | Herd et al. | |
| 4,440,232 | A * | 4/1984 | LeMoine | E21B 34/16 166/373 |
| 5,735,502 | A | 4/1998 | Levett et al. | |
| 6,164,619 | A * | 12/2000 | Van Winkle | E21B 33/062 137/112 |
| 7,195,224 | B2 * | 3/2007 | Le | F15B 15/261 251/1.3 |
| 7,628,207 | B2 * | 12/2009 | Leonardi | E21B 33/038 166/344 |
| 2003/0024705 | A1 | 2/2003 | Whitby et al. | |
| 2007/0137866 | A1 | 6/2007 | Ravensbergen et al. | |
| 2012/0205561 | A1 | 8/2012 | Baugh | |
| 2012/0279603 | A1 | 11/2012 | Swist | |

FOREIGN PATENT DOCUMENTS

| | | | |
|---|---|---|---|
| DE | 2538640 | A1 | 3/1977 |
| KR | 20130089460 | A | 8/2013 |

OTHER PUBLICATIONS

PCT Search Report and Written Opinion issued in connection with corresponding Application No. PCT/US2014/066534 on Mar. 26, 2015.

* cited by examiner

*Primary Examiner* — Matthew R Buck

*Assistant Examiner* — Douglas S Wood

(74) *Attorney, Agent, or Firm* — Bracewell LLP

(57) ABSTRACT

A blowout preventer (BOP) includes a pressure driven operator that is equipped with a balancing circuit to offset pressure inside the BOP. The operator, which is used to drive a ram, includes a piston, coupled to the ram by an operator arm, and a balance arm on a side of the piston opposite the operator arm. Pressure from inside the BOP communicates to an end of the balance arm opposite the piston and exerts a force to drive the ram radially inward.

18 Claims, 5 Drawing Sheets

PRESSURE ASSISTED BLOWOUT PREVENTER

BACKGROUND OF THE INVENTION

1. Field of Invention

The present disclosure relates in general to pressure assisted blowout preventer, and more specifically relates to using wellbore pressure to assist actuation of an operator in a blowout preventer.

2. Description of Prior Art

Wellbores in hydrocarbon bearing subterranean formations are formed by rotating a drill bit mounted on a lower end of a drill string. Typically, a wellhead housing is installed at the earth's surface and through which bit and string are inserted. A blow out preventer (BOP) stack usually mounts on top of the wellhead housing that provides pressure control of the wellbore, and often includes rams to shut in the wellbore should pressure in the wellbore become uncontrollable. Additional rams are often included with BOP stacks that are for shearing the string within the BOP stack, and also for pressure testing within the BOP. Further typically included with BOP stacks are flow lines and valves to allow fluid flow through the BOP stack for remediating overpressure in the wellbore.

Wellbore pressure communicates to inside the wellhead, and thus to the BOP; which generates a force that opposes ram and packer actuation. Pressure increases in the wellbore further increasing the force opposing ram and packer movement, thereby increasing the amount of force required for actuating the ram and packer. Rams and packers are generally hydraulically powered, and often by systems having limited capacity. Because a typical BOP is regularly tested, the resistive force created by wellbore pressure results in more frequent replenishment of the system, or installing actuation systems having larger capacity. Hydraulic systems with large capacity are not only costly, but impractical in some subsea applications.

SUMMARY OF THE INVENTION

Disclosed herein are example embodiments of a blowout preventer (BOP) with a hydraulic equalizing circuit, and methods of actuating a ram. An example embodiment of a BOP includes an annular body having a main bore in pressure communication with a wellbore, an operator assembly having an end that selectively projects radially into the body, a piston coupled with the operator assembly, and a balance rod coupled to a side of the piston distal from the main bore, and having a pressure surface in selective pressure communication with the main bore. The BOP may further include a piping circuit for providing selective communication between the pressure surface of the balance rod and the main bore. In this example, the piping circuit includes an accumulator vessel with opposite ends respectively in pressure communication with the main bore and the pressure surface of the balance rod, and a piston in the accumulator vessel that defines a fluid seal between the opposite ends, so that when pressure in the main bore is communicated to the pressure surface through the accumulator, the piston blocks fluid flow between the main bore and pressure surface. Further included in this example is a selector valve for controlling flow in a fluid path between the accumulator vessel and pressure surface of the balance rod and that is responsive to pressure in the main bore. An example of the selector valve allows pressure communication between the accumulator vessel and the pressure surface when the pressure in the main bore is above a designated pressure, and blocks pressure communication between the accumulator vessel and the pressure surface when the pressure in the main bore is below a designated pressure. In an alternative, the selector valve provides pressure communication between the pressure surface and a pressure source for driving piston when the pressure in the main bore is below a designated pressure. The piston can optionally be reciprocatingly disposed in a cavity of a cylinder. Examples exist wherein the balance rod is an elongate member that is substantially coaxial with the piston and inserts into a sealed plenum having a port that is in a path of fluid communication between the main bore and the pressure surface. In an alternative, the pressure surface is disposed in a plane that is generally parallel with an axis of the main bore. A ram is optionally mounted on the end of the operator assembly that projects radially into the body.

Another example of a BOP includes an annular body having a main bore in pressure communication with a wellbore, an operator assembly having an operational end that selectively projects radially inward into the annular body and into shearing contact with a tubular in the main bore, a pressure surface coupled with the operator assembly that faces radially outward from the operational end, and that is in selective pressure communication with the main bore. The pressure surface can be on a piston that is reciprocatingly disposed in a cylinder mounted to the annular body, so that exposing the pressure surface to pressure in the main bore, urges the piston radially inward to push the operational end into shearing contact with the tubular. Optionally, a piston can be coupled with the operator assembly and extend radially outward therefrom, and an elongate balance arm can be coupled to a side of the piston distal from the operator assembly, and wherein the pressure surface is on an end of the balance arm distal from the piston. In this example the side of the piston facing the balance arm is selectively pressurized to generate a piston force for urging the piston radially inward, and wherein the piston force is greater than a force exerted onto the pressure surface by communicating pressure from the main bore. The pressure between the main bore and pressure surface can be communicated through a piping circuit that comprises an accumulator having a piston that separates fluid from the main bore with fluid in the piping circuit that is in contact with the pressure surface. The BOP can further include a selector valve for selectively providing communication between the main bore and the pressure surface when pressure in the main bore is above a designated value, and blocking communication between the main bore and the pressure surface when pressure in the main bore is below a designated value. In this example, the pressure surface is on a piston that is reciprocatingly disposed in a cylinder mounted to the annular body, so that exposing the pressure surface to pressure in the main bore, urges the piston radially inward to push the operational end into shearing contact with the tubular, and wherein the selector valve diverts fluid in a low pressure side of the cylinder to ambient when the piston is urged radially inward.

An example method of actuating a ram in a BOP includes providing an operator assembly comprising operator arm that couples with the ram, and a pressure surface coupled with the operator arm that faces radially away from the ram, and selectively providing pressure communication between a main bore in the BOP and the pressure surface that generates a force which urges the operator arm and ram radially inward. In the method, a piston can be coupled with the operator arm, and wherein the pressure surface is disposed on a side of the piston facing away from the ram. Optionally in the method, a piston can be coupled with the operator arm and a balance arm can extend from the piston radially away from the ram, and wherein the pressure surface is on a portion of the balance arm distal from the ram, the method further comprising communicating pressure from a pressure source onto a surface of the piston facing away from the ram.

BRIEF DESCRIPTION OF DRAWINGS

Some of the features and benefits of the present invention having been stated, others will become apparent as the description proceeds when taken in conjunction with the accompanying drawings, in which.

Figure 1:
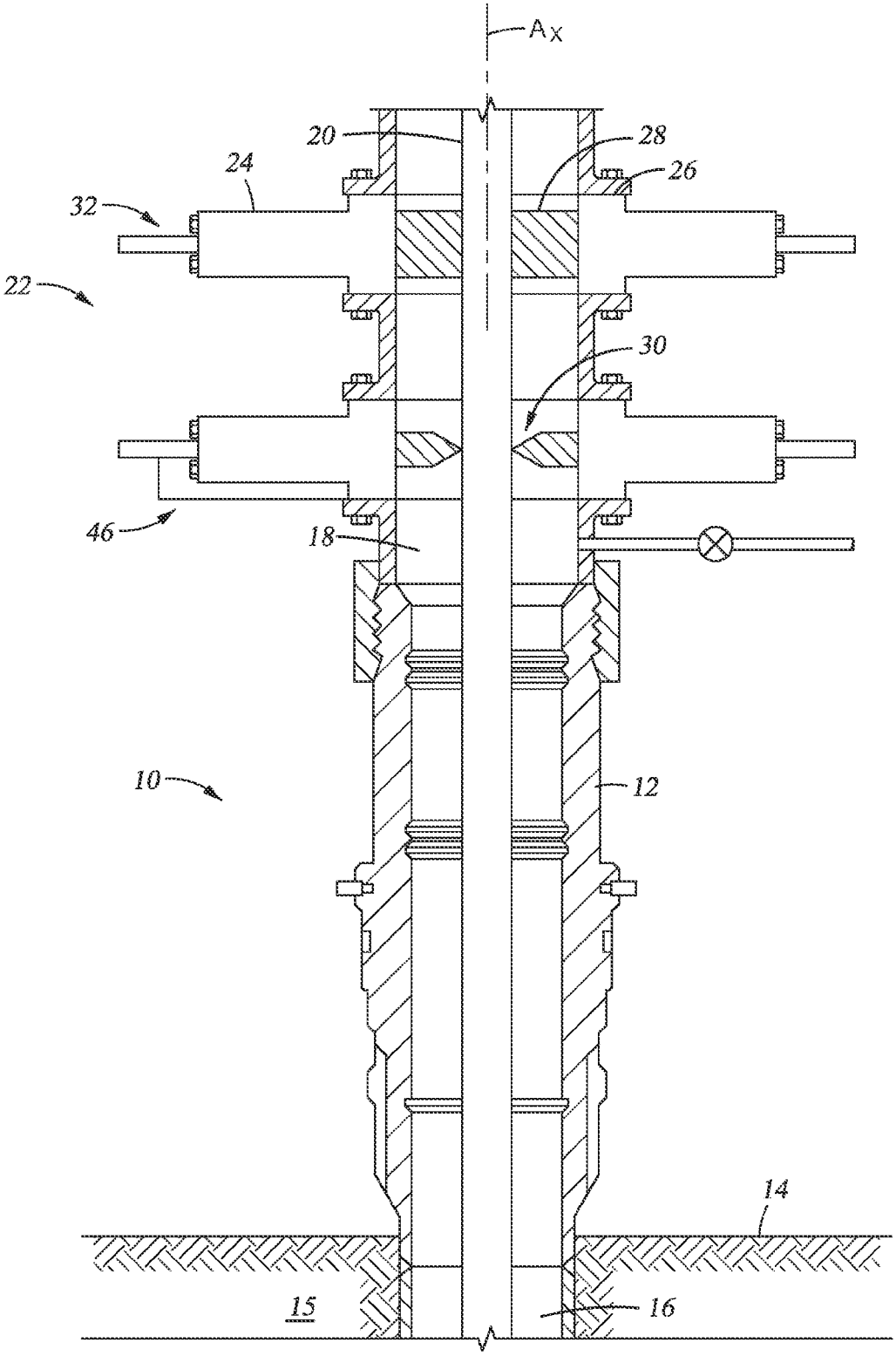
FIG. 1 is a side partial sectional view of an wellhead assembly with an example of a blowout preventer (BOP) in accordance with the present disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates in side partial sectional view an example of a wellhead assembly 10, which is made up of an annular wellhead housing 12 shown mounted into a surface 14. The surface 14 may be subsea or on ground, and is over a formation 15 intersected by a wellbore 16. The wellhead assembly 10 is mounted over wellbore 16. A main bore 18 extends axially within wellhead assembly 10, and is in communication with wellbore 16. A drill string 20 is shown inserted into main bore 18; and in the example of FIG. 1 is aligned with an axis $A_X$ of wellhead assembly 10. Wellhead assembly 10 of FIG. 1 includes a blowout preventer (BOP) 22 mounted on an upper end of wellhead housing 12. BOP 22 includes cylinders 24, and a main body 26, where cylinders 24 are shown attached on an outer surface of a main body 26 of BOP 22. In the example of FIG. 1, cylinders 24 have a circular outer surface and project radially outward from body 26. Cylinders 24 include operational assemblies for actuating a packer 28 shown projecting radially inward into contact with an outer surface of drill string 20. Optionally, shear rams 30 can be actuated with operational assemblies in cylinders 24. As will be described in greater detail below, plenums 32 project radially outward from ends of cylinders 24 distal from body 26. Plenums 32 are elongate with a generally circular outer surface, and have outer diameters less than diameters of cylinders 24.

Figure 2:
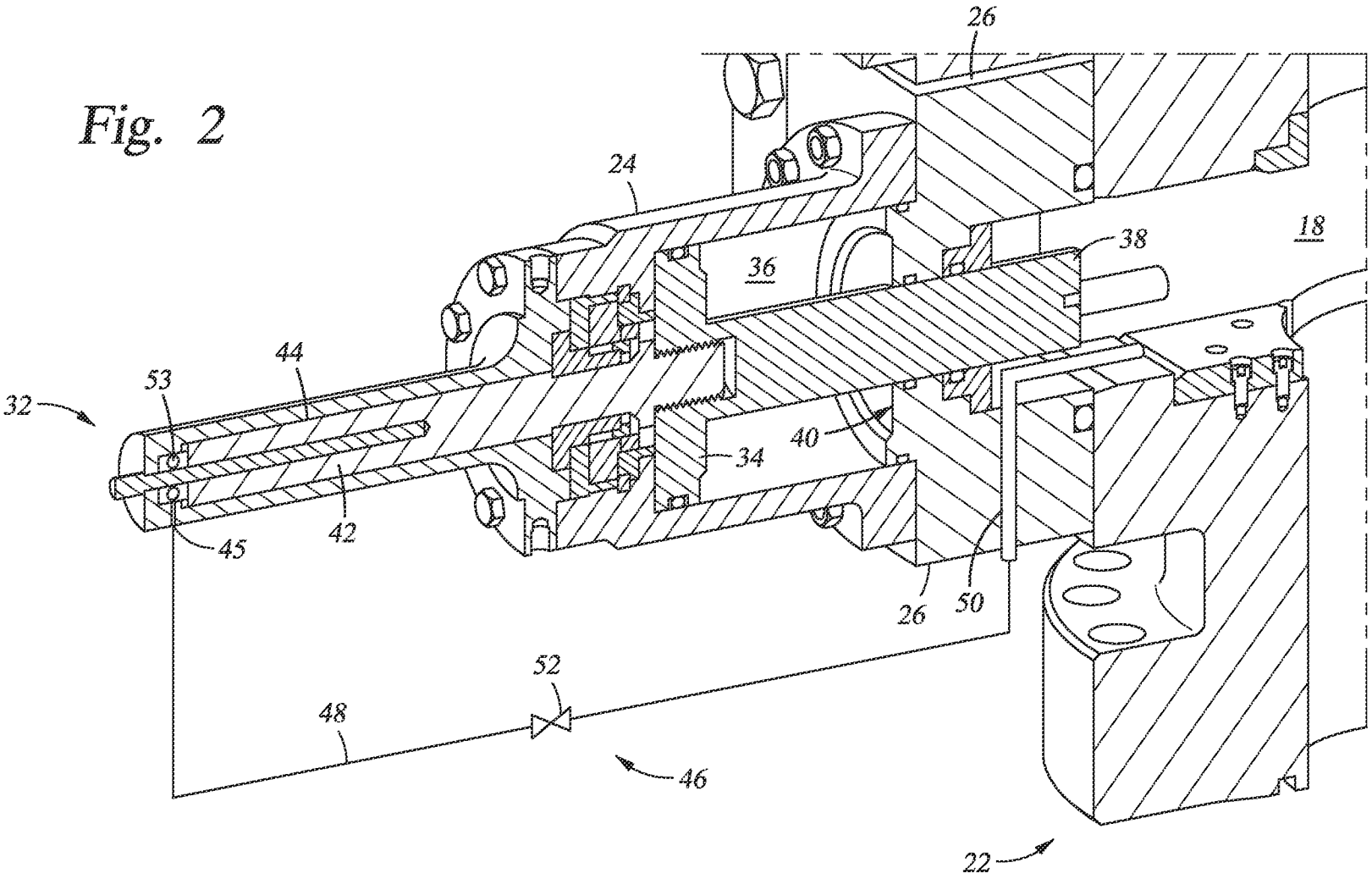
FIG. 2 is a sectional perspective view of an example of a portion of the BOP of FIG. 1 equipped with an embodiment of a fluid balancing circuit and in accordance with the present disclosure.

FIG. 2 shows in side perspective view a portion of BOP 22 and an example cylinder 24. A planar piston 34 is shown mounted within a cavity 36 provided within cylinder 24, and which can reciprocate within cavity 36 and coaxially to cylinder 24. An elongate operator arm 38 couples with and extends radially inward from piston 34, and which an example can be used for actuating one or both of the packer 28 or rams 30 (FIG. 1). In the example of FIG. 2, piston 34 is in a portion of cavity 36 distal from the main body 26, when piston 34 is located as shown, the packer 28 or ram 30 are in respective unactivated positions. As will be discussed in more detail below, urging the piston 34 in the cavity 36 to proximate to main body 26, moves the operator arm 38 radially inward towards axis $A_X$, for activating packer 28 or ram 30. A bore 40 is formed radially through a portion of body 26 to allow operator arm 38 to project from cylinder 36 and into a portion of BOP 20 in pressure communication with main bore 18. Seals are shown provided on a surface of bore 40 creating a pressure seal between operator arm 38 and bore 40.

A balance arm 42 is shown coupled with a side of piston 34 opposite its attachment to operator arm 38. Balance arm 42 is generally elongate and projects radially outward from piston 34 along a path generally coaxial with piston 34 and operator arm 38. Balance arm 42 extends from cavity 36 into a cavity 44 formed within plenum 32. Seal between balance arm 42 and cavity 44 isolates end of balance arm 42 from cavity 36. A port 45 is formed through a sidewall of plenum 32 and provides a pressure communication path between cavity 44 and a piping circuit 46 that provides selective pressure communication with main bore 18. Piping circuit 46 is made up of a line 48 having an end that connects to port 45, and has an opposite end connecting to a passage 50 formed in main body 26. An end of passage 50 opposite its connection with line 48 communicates with main bore 18. A valve 52 is provided in line 48 for controlling pressure communication through line 48, thereby selectively providing pressure communication between main bore 18 and cavity 44. As such, in one example of operation, valve 52 may be selectively opened so that pressure in main bore 18 can be applied to an end of balance arm 44 distal from piston 34, and in turn exert a force onto balance arm 42, thereby assisting piston 34 to urge operator arm 38 radially inward. In this example, a pressure surface 53 is defined on the end of balance arm 42 distal from piston 34, where the application of pressure in main bore 18 onto pressure surface 53 generates the force on balance arm 42, which counters the resistive force on the operator arm 38 produced by pressure in the main bore 18.

Figure 3:
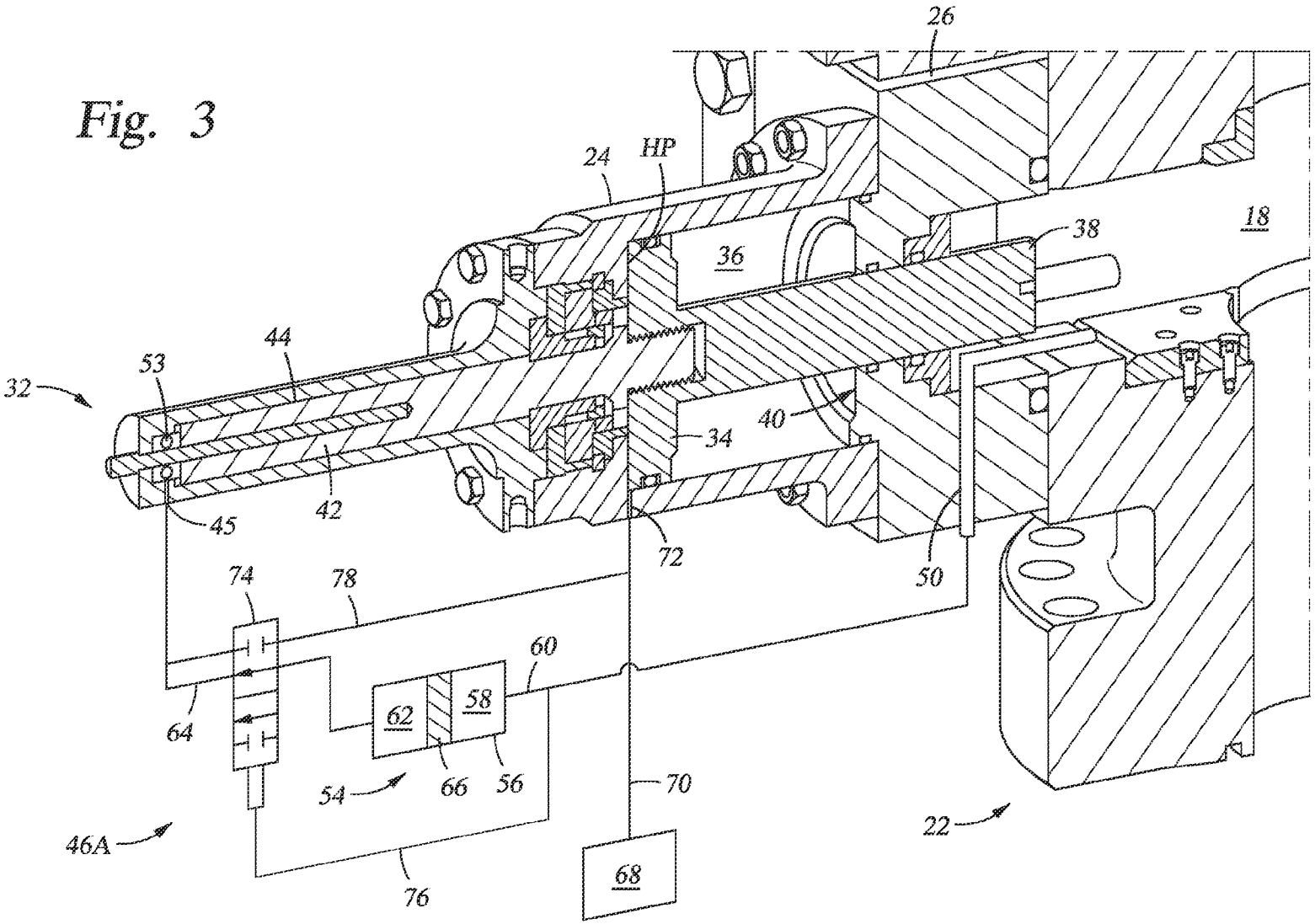
FIG. 3 is a sectional perspective view of the portion of the BOP of FIG. 2 and with an alternate embodiment of the fluid balancing circuit and in accordance with the present disclosure.

FIG. 3 illustrates an alternate embodiment of fluid circuit 46A that includes an accumulator 54 in a fluid path between main bore 18 and cavity 44. In this example, the accumulator 54 includes an outer housing 56. A well side 58 is defined in a portion of the accumulator 54 adjacent where a line 60 attaches to housing 56. Line 60 provides fluid and pressure communication between passage 50 and accumulator 54. A clean side 62 is shown in housing 56 and in a portion of accumulator 54 distal from well side 58. A line 64 connects to housing 56 adjacent to clean side 62, and provides selective communication between clean side 62 and port 45. A piston 66, which axially can reciprocate within accumulator 54, defines a barrier between well side 58 and clean side 62. In one example, clean side 62 and line 64 include a clean hydraulic fluid that is isolated from well side 58, line 60, and main bore 18. Thus, any contaminants that may be present in main bore 18 can be blocked and/or sealed from entering plenum 44 by accumulator 54.

Further in the example of FIG. 3, a pressure source 68 is schematically illustrated that is in fluid communication with cavity 36 via line 70. In the illustrated example of FIG. 3, line 70 is shown having one end connected to pressure source 68 and a distal end connected to a port 72, where port 72 extends through a side wall of cylinder 24 and into cavity 36. Pressure source 68 provides a motive force for urging piston 34 radially inward and driving operator arm 38 to actuate ram 30 (FIG. 1).

In one optional embodiment, a selector valve 74 is shown in line 64 for controlling communication between main bore 18 and cavity 44. Operation of selector valve 74 depends on pressure in main bore 18, which is communicated to selector valve 74 via tubing 76 shown having an upstream end connected to line 60 and a downstream end connected to a control port in selector valve 74. In one example of operation, when pressure in main bore 18 is at least as great as pressure in pressure source 68, selector valve 74 is positioned to allow flow through line 64. Under these conditions, exposing plenum 44, and thus pressure surface 53, to pressure in main bore 18 when it is greater than pressure from pressure source 68, increases the force exerted onto operator arm 18, and overcomes resistive forces generated from pressure in main bore 18 that are exerted radially outward against operator arm 38. Further shown in the example embodiment of FIG. 3 is that selector valve 74 is in line 78, and thereby controls fluid communication between line 70 and line 64. In an embodiment, when pressure in main bore 18 exceeds pressure in line 70 (from pressure source 68), selector valve 74 is set to block flow through line 78 thereby isolating plenum 44 from communication with line 70.

Still referring to FIG. 3, in another example of operation and when pressure in main bore 18 is less than pressure in pressure source 68, selector valve 74 is positioned to block flow through line 64, thereby isolating plenum 44 from main bore 18. Further in this example, selector valve 74 is selectively configured to allow flow through line 78 so that line 70 and plenum 44 are in communication, and generating a force onto balance arm 42 from pressure on pressure surface 53 supplied from pressure source 68 via lines 70, 78.

Figure 4:
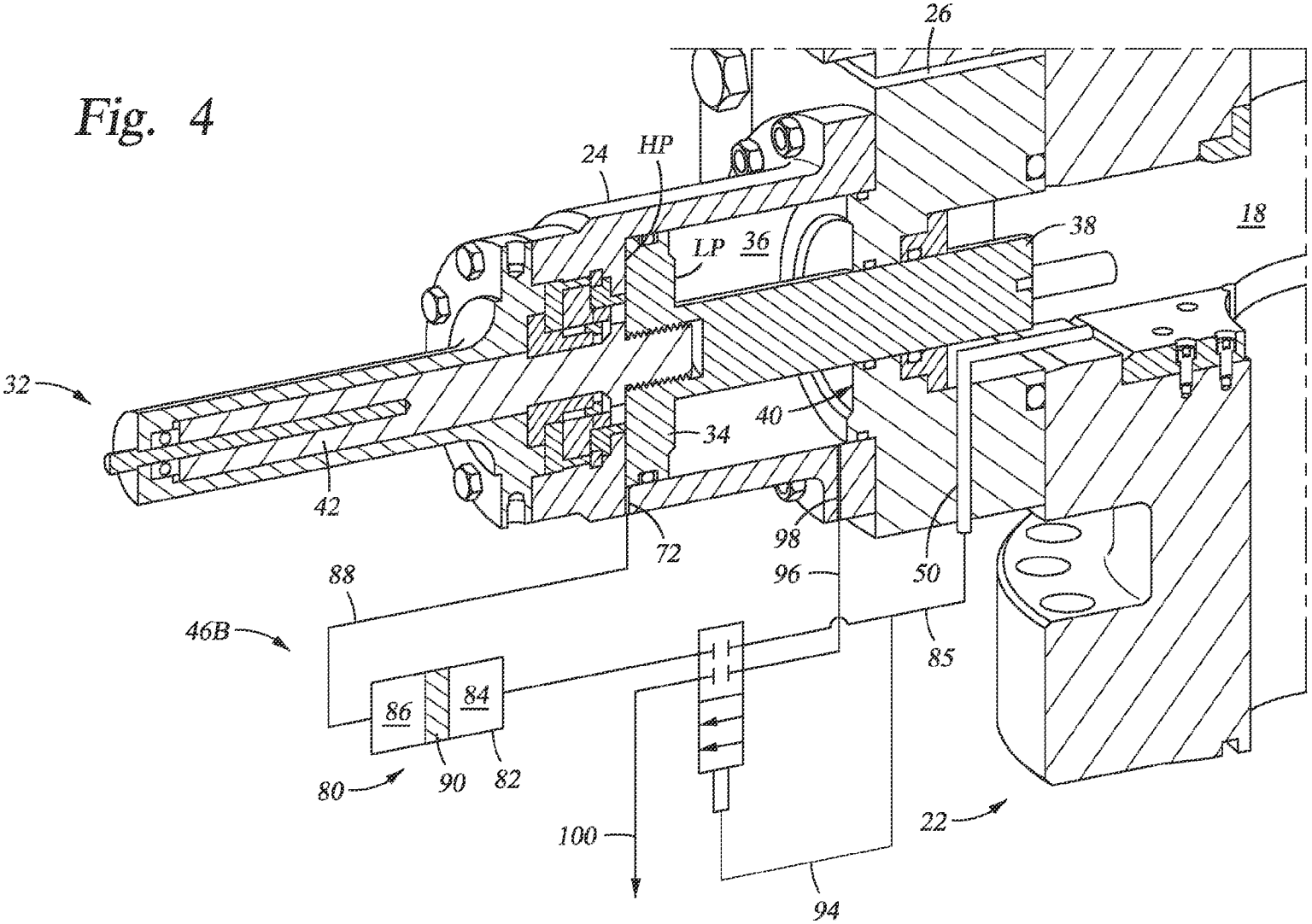
FIG. 4 is a sectional perspective view of the portion of the BOP of FIG. 2 and with an alternate embodiment of the fluid balancing circuit and in accordance with the present disclosure.

FIG. 4 illustrates a perspective partial sectional view of a portion of BOP 22 equipped with an alternate embodiment of piping circuit 46B. In this example, pressure from main bore 18 is communicated directly into cavity 36 for generating a force on piston 34 that in turn is exerted radially inward against operator arm 38. In this embodiment, although plenum 32 is shown on an outer end of cylinder 24, examples exist where cylinder 24 does not include plenum 32 or balance arm 42. Fluid circuit 46B includes an accumulator 80 (similar to accumulator 54 of FIG. 3) having a housing 82, in which a portion is designated as a well side 84. Line 85 connects to housing 82 adjacent well side 84 and another end to passage 50, thereby communicating pressure in main bore 18 to well side 84. Accumulator 80 includes a clean side 86, which is in communication with cavity 36 via line 88 that connects to housing 82 on one end and to port 72 on its distal end. A piston 90 provides a flow barrier between well side 84 and clean side 86 so that any fluid from main bore 18 is isolated from clean side 86, line 88, and cavity 36. The embodiment of the piping circuit 46B shown in FIG. 4 further includes a selector valve 92 disposed in line 85 for controlling flow from main bore 18 and into cavity 36. Selector valve 92 operates contingent on pressure in main bore 18, which is communicated to selector valve 92 via tubing 94. In the illustrated example of FIG. 4, tubing 94 has an upstream end connected to line 85 and a downstream end connected to a control port on selector valve 92.

An optional discharge line 96 is shown connected to a port 98 on an upstream end, where line 96 and port 98 are for dumping fluid from cavity 36 on the low pressure side LP of piston 34 when piston 34 is urged radially inward. Port 98 is formed through a side wall of cylinder 24 on a low pressure side of piston 34, and discharge line 96 connects to selector valve 92 on a downstream end. In one example of operation, a pressure kick or other high pressure episode is experienced in main bore 18, packer 28 (FIG. 1) may close thereby increasing pressure in main bore 18. In an optional embodiment, when pressure in main bore 18 reaches a designated pressure, such as the rated working pressure of packer 28, selector valve 92 is set to a position allowing fluid communication through line 85 thereby communicating pressure from main bore 18 to the high pressure side HP of piston 34 via fluid circuit 46B. In examples where the space in cavity 36 on the low pressure side of piston 34 includes a fluid, the selector valve may be set to vent the fluid and thus in a position allowing communication between line 96 and a discharge line 100 for allowing fluid in low pressure side of cavity 36 to vent through line 96, selector valve 92 and exit from line 100 which enables piston to move radially inward within cylinder 24. An advantage of the line on pressure in main bore 18 has an actuation source of operator assembly, is that leak paths and other issues with externally applied working fluid can be eliminated. Additionally, weight of the BOP can be reduced by eliminating the need for hardware, such as accumulator count requirement.

Figure 5:
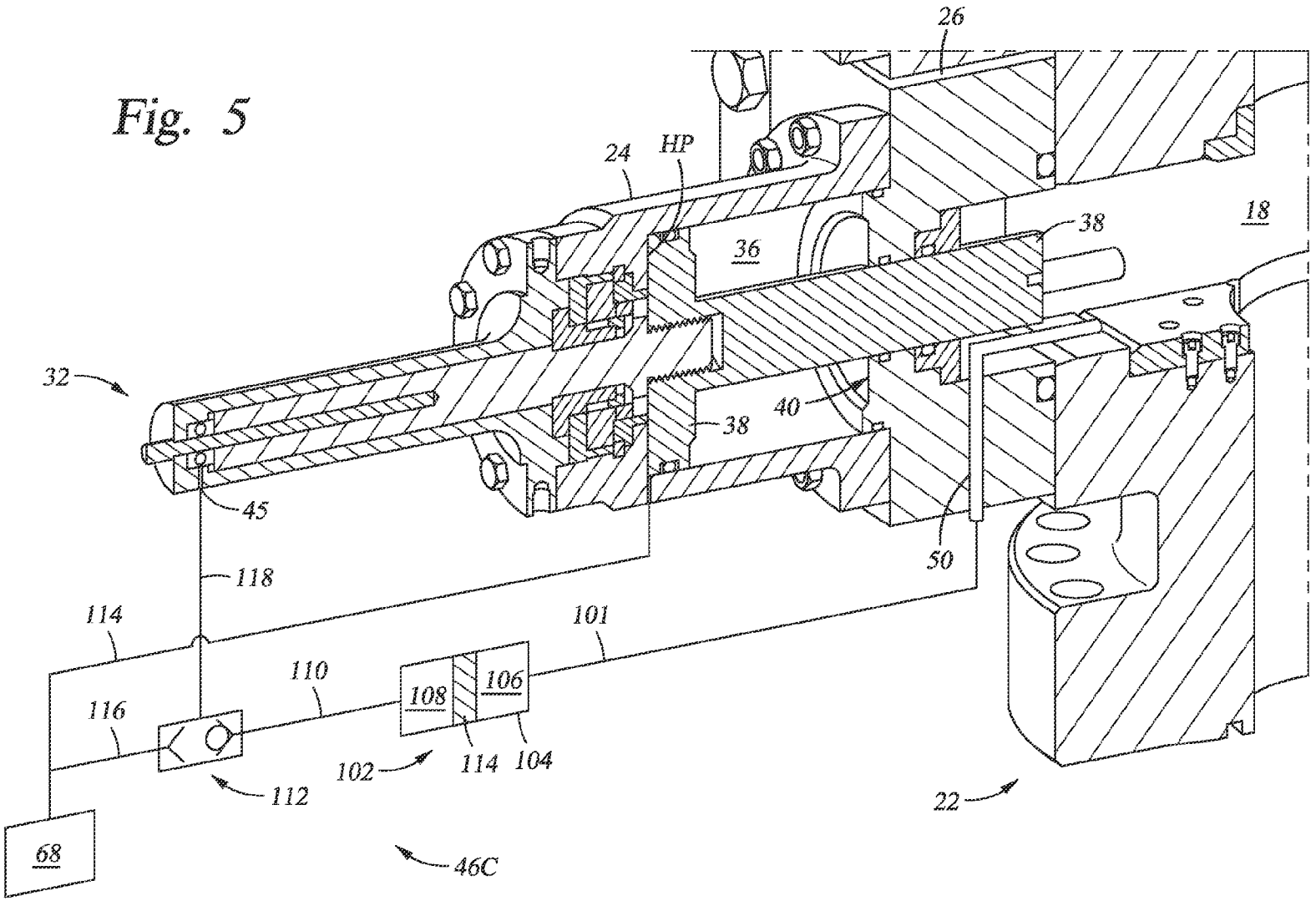
FIG. 5 is a sectional perspective view of the portion of the BOP of FIG. 2 and with an alternate embodiment of the fluid balancing circuit and in accordance with the present disclosure.

In the alternate example of FIG. 5, circuit 46C includes a line 101 communicating pressure in main bore 18 to accumulator 102. Accumulator 102 includes a housing 104, a well side 106 in housing 104 adjacent to connection to line 101. A clean side 108 is in housing 104, an upstream end of a line 110 connects to housing 104 adjacent clean side 108, line 110 has a downstream end that connects to a double check valve 112. A piston 114 in housing 104 separates well side 106 from clean side 108. Pressure source 68 is schematically shown connected to high pressure side HP of piston 38 via line 114. Line 116 connects line 114 to a side of check valve 112 opposite its connection to line 110. Outlet line 118 connects check valve 112 to port 45, thus communicating check valve 112 with plenum 32. In an example of operation of the embodiment of FIG. 5, when pressure in main bore 18 exceeds pressure from pressure source 68, fluid in clean side 108 and line 110 is urged through double acting check valve 112, through line 118 and into plenum 32 via port 45. In this mode of operation, check valve 112 blocks from therein from line 116. Alternatively, when pressure of fluid from pressure source 68 is greater than main bore 18, check valve 112 blocks flow from line 110, thereby allowing flow from line 114, through line 116, into check valve 112, and into plenum 32 via line 118 and port 45.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A blowout preventer (BOP) comprising:

an annular body having a main bore in pressure communication with a wellbore;

an operator assembly having an end that selectively projects radially into the body;

a piston coupled with the operator assembly; and a balance rod coupled to a side of the piston distal from the main bore, and having a pressure surface in selective pressure communication with the main bore, so that the pressure on the balance rod at the pressure surface mirrors the pressure in the main bore when the pressure surface is in pressure communication with the main bore.

2. The BOP of claim 1, further comprising a piping circuit for providing selective communication between the pressure surface and the main bore.

3. The BOP of claim 2, wherein the piping circuit comprises an accumulator vessel with opposite ends respectively in pressure communication with the main bore and the pressure surface, and a piston in the accumulator vessel that defines a fluid seal between the opposite ends, so that when pressure in the main bore is communicated to the pressure surface through the accumulator, the piston blocks fluid flow between the main bore and pressure surface.

4. The BOP of claim 3, further comprising a selector valve for controlling flow in a fluid path between the accumulator vessel and pressure surface and that is responsive to pressure in the main bore.

5. The BOP of claim 4, wherein the selector valve allows pressure communication between the accumulator vessel and the pressure surface when the pressure in the main bore is above a designated pressure, and blocks pressure communication between the accumulator vessel and the pressure surface when the pressure in the main bore is below a designated pressure.

6. The BOP of claim 4, wherein the selector valve provides pressure communication between the pressure surface and a pressure source for driving piston when the pressure in the main bore is below a designated pressure.

7. The BOP of claim 1, wherein the piston is reciprocatingly disposed in a cavity of a cylinder.

8. The BOP of claim 1, wherein the balance rod is an elongate member that is substantially coaxial with the piston and inserts into a sealed plenum having a port that is in a path of fluid communication between the main bore and the pressure surface.

9. The BOP of claim 1, wherein the pressure surface is disposed in a plane that is generally parallel with an axis of the main bore.

10. The BOP of claim 1, wherein a ram is mounted on the end of the operator assembly that projects radially into the body.

11. A blowout preventer (BOP) comprising:

an annular body having a main bore in pressure communication with a wellbore;

an operator assembly having an operational end that selectively projects radially inward into the annular body and into shearing contact with a tubular in the main bore;

a pressure surface coupled with the operator assembly that faces radially outward from the operational end, and that is in selective pressure communication with the main bore, so that the pressure at the pressure surface mirrors the pressure in the main bore when the pressure surface is in pressure communication with the main bore;

wherein a piston is coupled with the operator assembly and extends outward therefrom, and an elongate balance arm couples to a side of the piston distal from the operator assembly, and wherein the pressure surface is on an end of the balance arm distal from the piston.

12. The BOP of claim 11, wherein the side of the piston facing the balance arm is selectively pressurized to generate a piston force for urging the piston radially inward, and wherein the piston force is greater than a force exerted onto the pressure surface by communicating pressure from the main bore.

13. The BOP of claim 11, wherein pressure between the main bore and pressure surface is communicated through a piping circuit that comprises an accumulator having a piston that separates fluid from the main bore with fluid in the piping circuit that is in contact with the pressure surface.

14. The BOP of claim 11, further comprising a selector valve for selectively providing communication between the main bore and the pressure surface when pressure in the main bore is above a designated value, and blocking communication between the main bore and the pressure surface when pressure in the main bore is below a designated value.

15. The BOP of claim 14, wherein the pressure surface is on a piston that is reciprocatingly disposed in a cylinder mounted to the annular body, so that exposing the pressure surface to pressure in the main bore, urges the piston radially inward to push the operational end into shearing contact with the tubular, and wherein the selector valve diverts fluid in a low pressure side of the cylinder to ambient when the piston is urged radially inward.

16. A method of actuating a ram in a blowout preventer (BOP) comprising:

providing an operator assembly comprising an operator arm that couples with the ram, and a pressure surface coupled with the operator arm that faces radially away from the ram; and selectively providing pressure communication between a main bore in the BOP and the pressure surface so that the pressure on the pressure surface mirrors the pressure in the main bore when the pressure surface is in pressure communication with the main bore, and so that the pressure communication generates a force which urges the operator arm and ram radially inward, wherein a piston is coupled with the operator arm and a balance arm extends from the piston radially away from the ram, and wherein the pressure surface is on a portion of the balance arm distal from the ram.

17. The method of claim 16, wherein a piston is coupled with the operator arm, and wherein the pressure surface is disposed on a side of the piston facing away from the ram.

18. The method of claim 16, the method further comprising communicating pressure from a pressure source onto a surface of the piston facing away from the ram.

* * * * *